US005154236A

United States Patent [19]

Eurbin

[11] Patent Number: 5,154,236

[45] Date of Patent: Oct. 13, 1992

[54] FIRE EXTINGUISHING APPARATUS

[76] Inventor: Edward B. Eurbin, 95 Curtis St., Box 817, Hinsdale, Mass. 01235

[21] Appl. No.: 771,115

[22] Filed: Oct. 4, 1991

[51] Int. Cl.[5] ..... A62C 3/06

[52] U.S. Cl. ..... 169/52; 169/49; 169/69

[58] Field of Search ..... 169/69, 43, 47, 49, 169/52

[56] References Cited

U.S. PATENT DOCUMENTS 739,377 9/1903 Bell ..... 169/69 X

*Primary Examiner*—Margaret A. Focarino

*Assistant Examiner*—Andrew C. Pike

*Attorney, Agent, or Firm*—Leon Gilden

[57] ABSTRACT

A semicylindrical hood is formed with a lower beveled cutting edge arranged for positioning above an oil well fire and its projection, wherein the edge is arranged for a digging into a surrounding environment relative to the fire to effect its discontinuance of oxygen thereto. A first halogen gas conduit and a second water conduit are directed into the hood to effect extinguishing and cooling of a fire contained therewithin. Various guide loops are mounted about the lower edge perimeter for guidance of the hood relative to an associated oil well fire. A pressure relief valve, as well as a temperature indicator organization, is mounted through the hood.

6 Claims, 4 Drawing Sheets

FIRE EXTINGUISHING APPARATUS

BACKGROUND OF THE INVENTION

1. Field of the Invention

The field of invention relates to fire extinguishing apparatus, and more particularly pertains to a new and improved fire extinguishing apparatus arranged for the extinguishment of oil well fires.

2. Description of the Prior Art

Oil well fires are notoriously hazardous and dangerous due to the enormity of the associated fire and an almost limitless supply of fuel. The instant invention attempts to overcome deficiencies of the prior art by providing a hood structure to effect discontinuous oxygen supply to the associated fire, as well as means for directing fire extinguishing gas and fluids into the fire.

Fire extinguishing apparatus has been utilized in the prior art to approach various fire situations such as exemplified in U.S. Pat. No. 4,136,851 to Hansen et al. utilizing a proportional valve arrangement to effect distribution of a fire extinguishing gas.

It may be appreciated therefore that there continues to a need for a new and improved fire extinguishing apparatus as set forth by the instant invention which addresses both the problems of ease of use as well as effectiveness in construction in addressing the extinguishment of oil well fires and, in this respect, the present invention substantially fulfills this need.

SUMMARY OF THE INVENTION

The present invention provides a fire extinguishing apparatus utilizing a rigid hood member formed with a sharpened lower perimeter edge to effect encasement of an oil well fire. As such, the general purpose of the present invention, which will be described subsequently in greater detail, is to provide a new and improved fire extinguishing apparatus.

To attain this, the present invention provides a semicylindrical hood formed with a lower beveled cutting edge arranged for positioning above an oil well fire and its projection, wherein the edge is arranged for a digging into a surrounding environment relative to the fire to effect its discontinuance of oxygen thereto. A first halogen gas conduit and a second water conduit are directed into the hood to effect extinguishing and cooling of a fire contained therewithin. Various guide loops are mounted about the lower edge perimeter for guidance of the hood relative to an associated oil well fire. A pressure relief valve, as well as a temperature indicator organization, is mounted through the hood.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is another object of the present invention to provide a new and improved fire extinguishing apparatus which may be easily and efficiently manufactured and marketed.

It is a further object of the present invention to provide a new and improved fire extinguishing apparatus which is of a durable and reliable construction.

An even further object of the present invention is to provide a new and improved fire extinguishing apparatus which is capable of a low cost of manufacture with regard to both materials and labor, and which accordingly is then capable of low prices of sale to consumers, thereby making such fire extinguishing apparatus economically available to the buying public.

These together with other objects of the invention, along with the various features of novelty which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
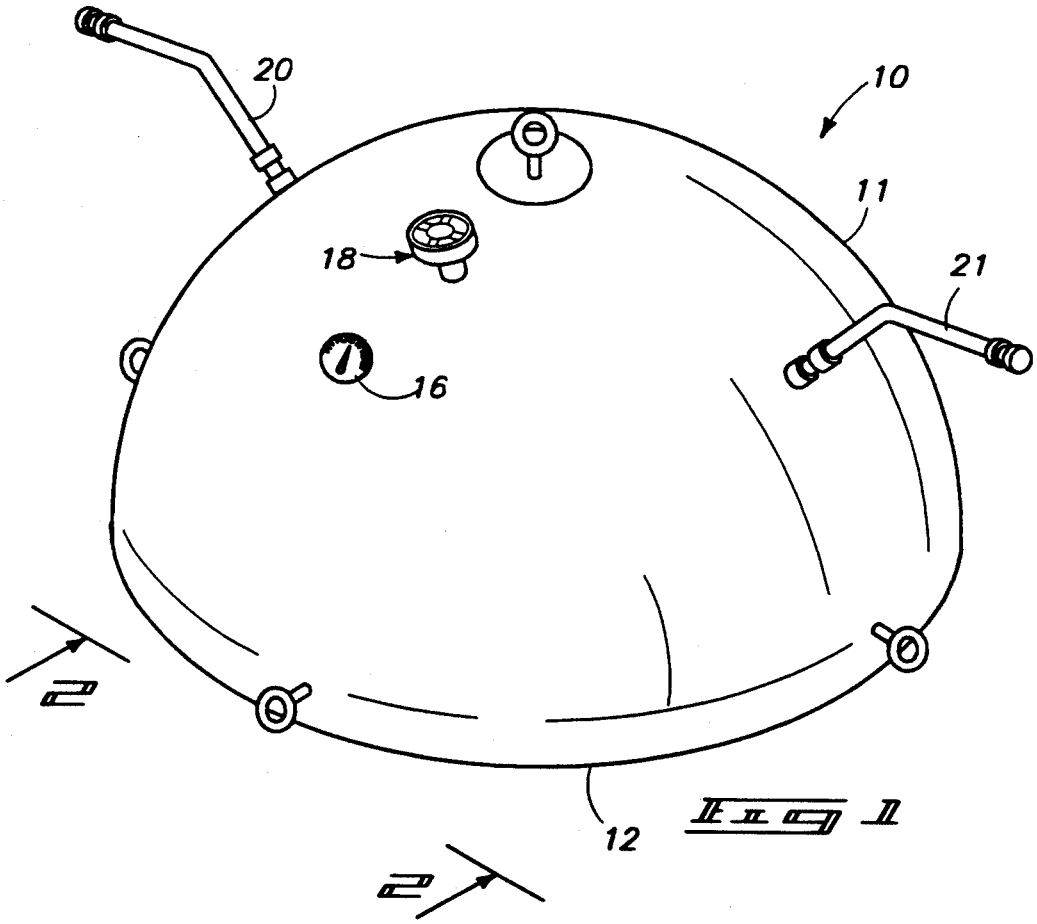
FIG. 1 is an isometric illustration of the instant invention.
Figure 2:
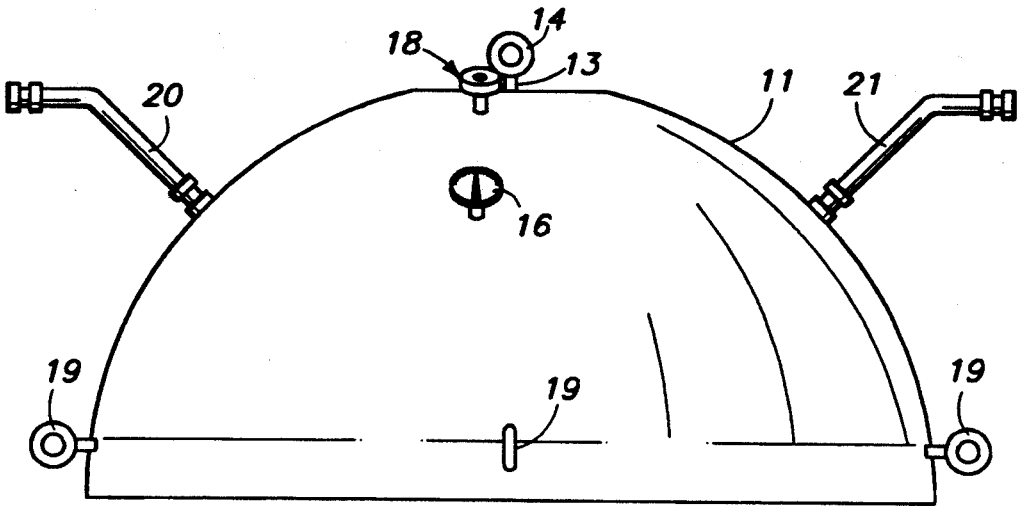
FIG. 2 is an orthographic side view, taken along the lines 2—2 of FIG. 1 in the direction indicated by the arrows.
Figure 3:
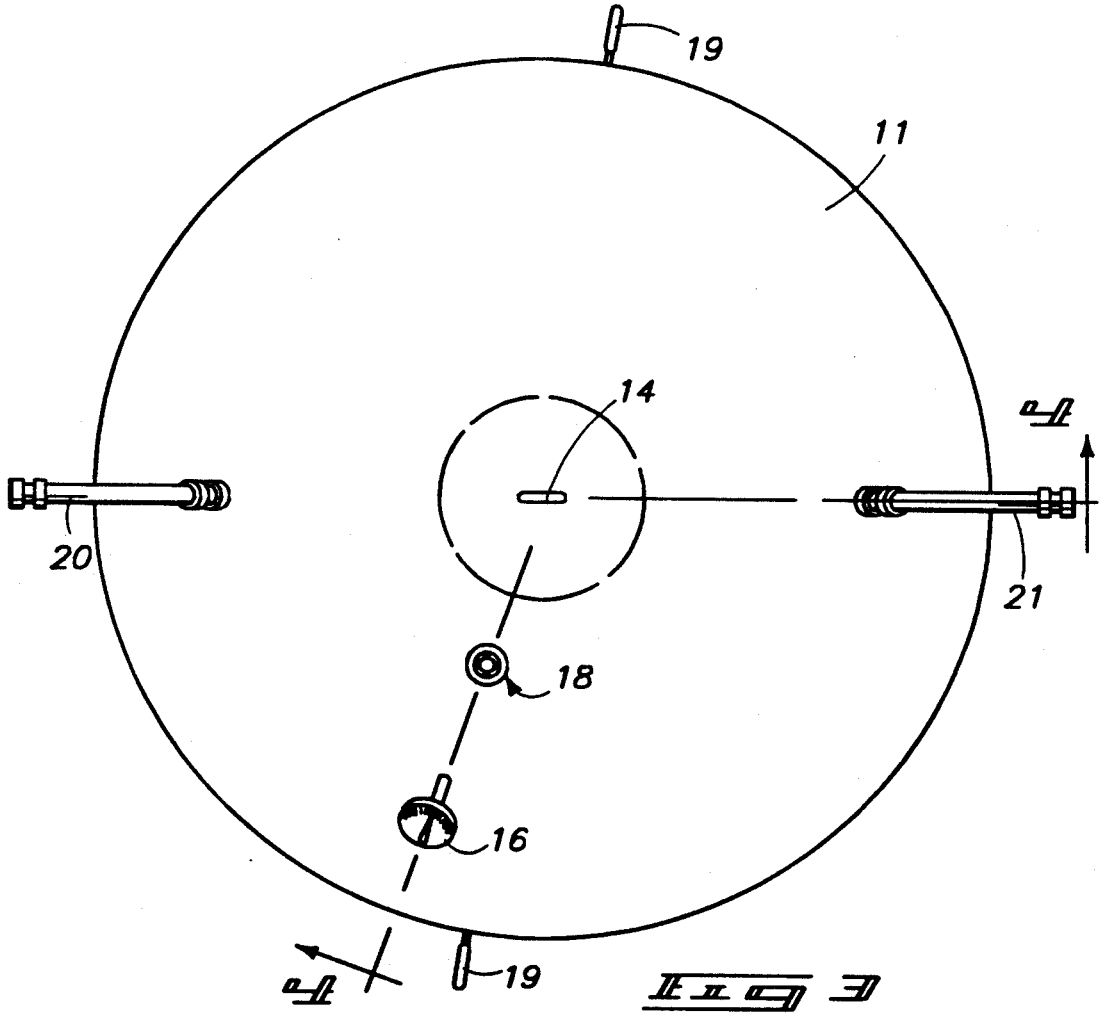
FIG. 3 is an orthographic top view of the instant invention.
Figure 4:
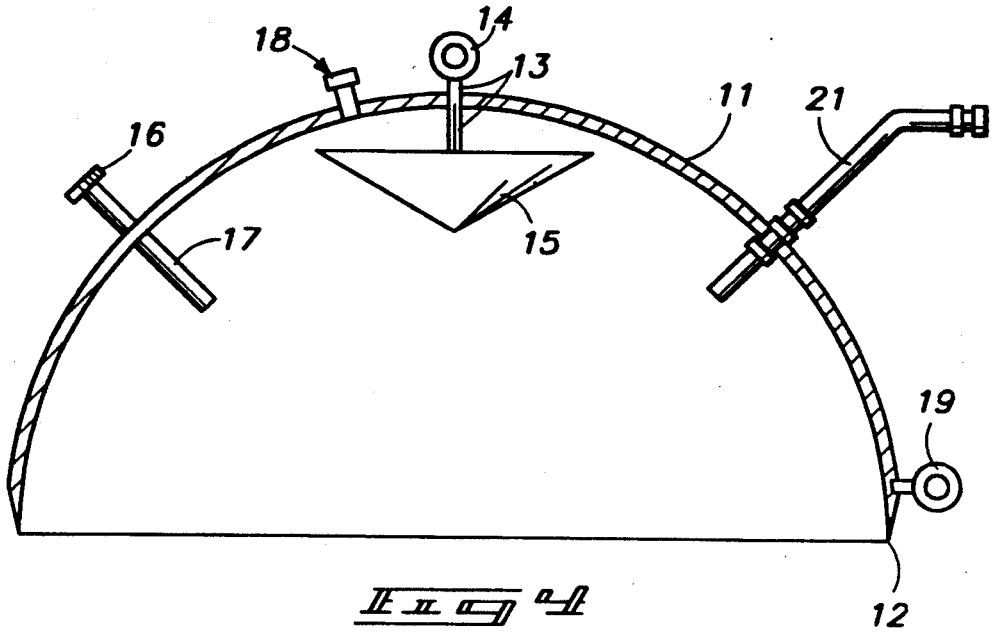
FIG. 4 is cross-sectional view, taken along the lines 4—4 of FIG. 3 in the direction indicated by the arrows.

With reference now to the drawings, and in particular to FIGS. 1 to 10 thereof, a new and improved fire extinguishing apparatus embodying the principles and concepts of the present invention and generally designated by the reference numeral 10 will be described.

More specifically, the fire extinguishing apparatus 10 of the instant invention essentially comprises a semicylindrical hood 11 formed with a lower beveled cutting edge 12, wherein the cutting edge is arranged in a single plane orthogonally oriented relative to the axis of the hood 11. A support rod 13 projecting diametrically through the hood is coincident with the axis thereof and includes a lifting loop 14 mounted at an upper distal end exteriorly of the hood, and an inverted conical deflecting shield 15 mounted at a lower distal end interiorly of the hood to deflect spraying oil and deflect oil throughout the hood's interior surface. A thermometer head 16 is mounted exteriorly of the hood to include a sensor rod 17 projecting into the hood to provide for temperature detection therewithin as to the level and intensity of fire contained therewithin. It should be noted that the cutting edge 12 is arranged whereupon the hood is typically lifted by crane and the like to a fire site utilizing the guide rings 19 that are equally spaced about the hood adjacent the cutting edge 12, whereupon the hood is typically dropped a distance and the cutting edge permits a digging in of the hood in a surrounding relationship relative to the fire to enhance encasement of the fire and to limit oxygen access of a fire contained therewithin the hood. To this end, a halogen gas conduit 20 is directed into the hood and is spaced from a water conduit 21 directed into the hood, wherein the water conduit is effected to depress fire temperatures within the hood and the halogen gas directed through the halogen gas conduit 20 arranged to effect a snuffing of the fire therewithin.

Figure 5:
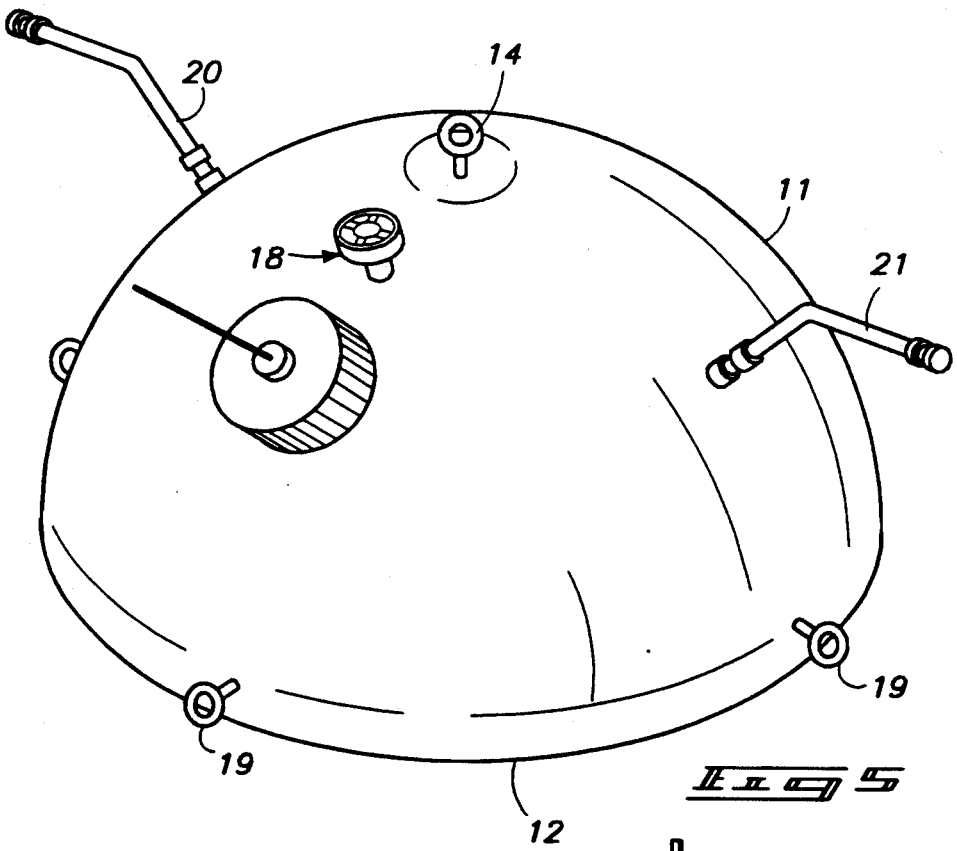
FIG. 5 is an isometric illustration of the invention utilizing a temperature relay device.
Figure 6:
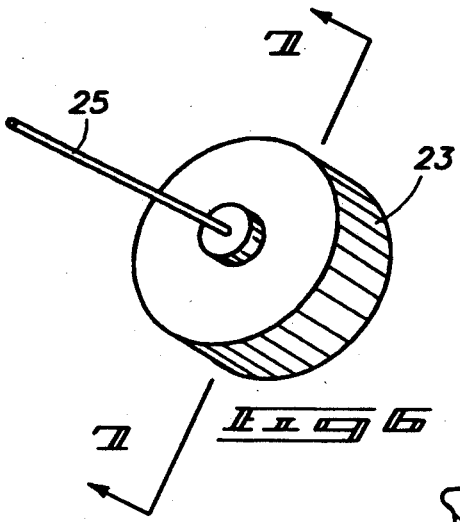
FIG. 6 is an enlarged isometric illustration of the temperature relay housing.
Figure 7:
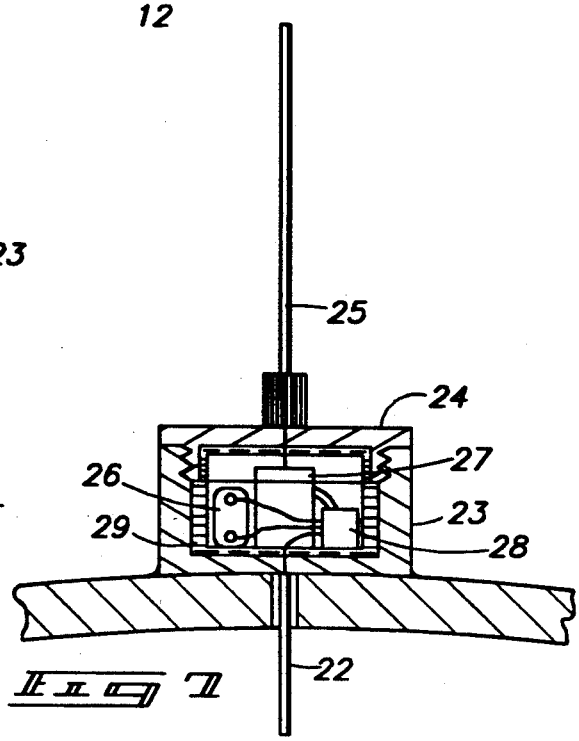
FIG. 7 is an orthographic view, taken along the lines 7—7 of FIG. 6 in the direction indicated by the arrows.
Figure 8:
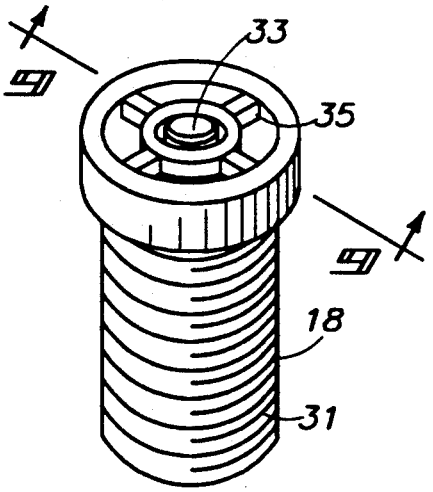
FIG. 8 is an isometric illustration of the pressure relief valve utilized by the invention.
Figure 9:
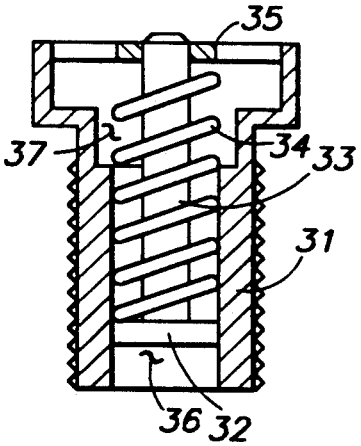
FIG. 9 is cross-sectional view, taken along the lines 9—9 of FIG. 8 in the direction indicated by the arrows.
Figure 10:
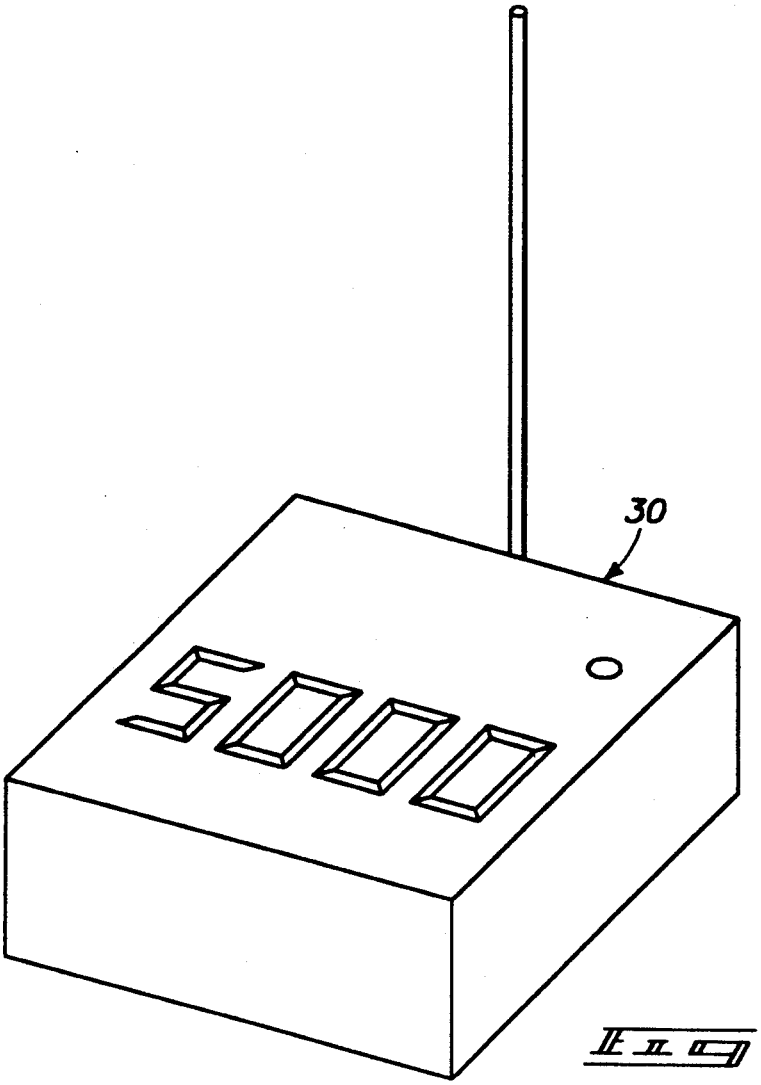
FIG. 10 is an isometric illustration of the receiver unit utilized by the invention.

The FIGS. 5–7 illustrate the use of a temperature transmitter utilizing a temperature transmit housing 23, including a temperature probe 22 in communication with the housing directed interiorly of the hood. The housing includes a lid removable therefrom for providing periodic servicing of components contained therewithin such as a battery 26 in communication with a transmitter 27 and a transducer 28 to relay temperatures from the temperature probe through the transmit antenna 25 to a receiving member or receiver 30, such as the type as illustrated in FIG. 10. The housing further is provided with an insulated liquid layer 29 coextensively directed throughout an interior surface of the lid and the housing in surrounding relationship relative to the battery, transmitter, and transducer to limit damage to the components in use.

A pressure relief valve 18, as illustrated, directed through the hood 11 includes a pressure relief body 31 formed with a first bore 36 coaxially directed therethrough initiating at a lower terminal end of the body and projecting a predetermined axial length therealong, with communication to a second bore 37 defined by a second diameter greater than the first diameter defined by the first bore 36. A piston head 32 normally maintained within the first bore 36 is defined by a piston head diameter substantially equal to the first diameter, and includes a piston rod 33 coaxially directed through the first and second bores 36 and 37 projecting through the vented valve top wall 35 that is orthogonally oriented relative to the body axis of the body 31. Upon a predetermined pressure being developed, the piston 32 is projected into the first bore 36 against force of the spring 34, whereupon passage of the piston into the second bore 37 permits gases to vent through the second bore and exteriorly of the top wall 35.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function, and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes thereof will readily occur to those skilled in the art, it is not desired to limit the invention to the exact construction and operation shown and described, and accordingly, all suitable modifications and equivalents may be resorted to falling within the scope of the invention.

What is claimed as being new and desired to be protected by Letters Patent of the United States is as follows:

1. A fire extinguishing apparatus for mounting in surrounding relationship relative to an oil well fire, the apparatus including a semicylindrical hood defining a concave cavity therewithin, wherein the hood includes a lower beveled cutting edge formed at a hemispherical perimeter of the hood, wherein the hood is defined by a hood axis and the beveled edge is contained within a single plane orthogonally oriented relative to the hood axis, and a support rod coincident with the hood axis projecting through the hood, wherein an upper distal end includes a lifting loop positioned exteriorly of the hood and a lower distal end of the support rod includes an inverted conical deflecting shield contained within the cavity.

2. An apparatus as set forth in claim 1 further including temperature sensor means, wherein the temperature sensor means is mounted to the hood and includes a sensor probe directed into the cavity for detection of temperatures within the cavity.

3. An apparatus as set forth in claim 2 wherein the temperature sensor means includes a housing, the housing being mounted fixedly to the hood exteriorly thereof, with a transmitter contained within the housing, and a battery, and a transducer to effect interpolation of said temperatures obtained by the probe, and an antenna mounted to the housing to direct a signal by the transducer, and a receiver remotely spaced from the transmitter and the hood for effecting reception of said signal from the transmitter.

4. An apparatus as set forth in claim 3 wherein the housing includes a liquid insulative layer coextensively directed within the housing to afford protection from heat to the battery, the transmitter, and the transducer.

5. An apparatus as set forth in claim 4 with a pressure relief valve mounted through the hood, and a halogen gas transmission conduit directed through the hood, and a water transmission conduit spaced from the halogen gas conduit mounted through the hood, wherein the halogen gas conduit is arranged to direct halogen gas therethrough, and the water conduit is to direct water therethrough.

6. An apparatus as set forth in claim 5 wherein the pressure relief valve includes a pressure relief body directed through the hood into the cavity, wherein the pressure relief body includes a first bore directed from a lower terminal end of the body coaxially with the body in communication with a second bore projection from the first bore, wherein the second bore is defined by a second diameter and the first bore is defined by a first diameter, and wherein the second diameter is greater than the first diameter, and a piston head slidably contained within the first bore, and a piston rod orthogonally and coaxially aligned within the body mounted to the piston head, and a spring captured between the piston head and a valve top wall positioned exteriorly of the body, whereupon the piston head is slidably directed at a predetermined elevated pressure past the first bore to the second bore to permit passage of pressurized gas through the first bore, the second bore, and the top wall.

* * * * *